US007975745B2

(12) United States Patent
Matsushita et al.

(10) Patent No.: US 7,975,745 B2
(45) Date of Patent: Jul. 12, 2011

(54) TRANSFER TOOL

(75) Inventors: Kinya Matsushita, Osaka (JP); Hideto Shima, Kyoto (JP)

(73) Assignee: Kokuyo Co., Ltd., Osaka-shi, Osaka (JP)

( * ) Notice: Subject to any disclaimer, the term of this patent is extended or adjusted under 35 U.S.C. 154(b) by 921 days.

(21) Appl. No.: 10/572,943

(22) PCT Filed: Apr. 26, 2005

(86) PCT No.: PCT/JP2005/007933
§ 371 (c)(1),
(2), (4) Date: Jan. 17, 2007

(87) PCT Pub. No.: WO2005/108260
PCT Pub. Date: Nov. 17, 2005

(65) Prior Publication Data

US 2007/0189829 A1 Aug. 16, 2007

(30) Foreign Application Priority Data

May 6, 2004 (JP) ..... 2004-137808

(51) Int. Cl.
*B41J 35/02* (2006.01)

(52) U.S. Cl. ..... 156/577; 156/523; 156/230; 156/237; 156/574; 156/579; 156/238; 156/540; 156/544; 118/207; 24/518; 24/543; 24/487

(58) Field of Classification Search ..... 156/577, 156/523, 230, 238, 527, 574, 237, 579, 202, 156/391, 526, 540, 544; 24/518, 543, 574, 24/170, 487; 118/207
See application file for complete search history.

(56) References Cited

U.S. PATENT DOCUMENTS 4,851,076 A * 7/1989 Manusch et al. ..... 156/577
(Continued)

FOREIGN PATENT DOCUMENTS

JP 10-45152 2/1998
(Continued)

OTHER PUBLICATIONS

International Search Report of PCT/JP2005/007933 dated Jun. 21, 2005.

(Continued)

*Primary Examiner* — Khanh Nguyen
*Assistant Examiner* — Keith T Aziz
(74) *Attorney, Agent, or Firm* — Westerman, Hattori, Daniels & Adrian, LLP

(57) ABSTRACT

In order to provide a good transferable and extremely usable transfer tool in which consumable supplies can be easily replaced while increasing rigidity in use and case assembling procedure is also simple, the transfer tool (A) includes a case body (1) which incorporates a transfer material (T), the case body (1) having a first case (2) for holding replacement parts including at least the transfer material (T); and a second case (3) engageable with and disengageable from the first case (2), for holding unchangeable parts constituting at least a part of feeding mechanism parts which feeds out the transfer material (T) to a transferred object, wherein a holding portion (K) for holding the case body (1) to a base (4) in a state where the first case (2) and the second case (3) are engaged, and a pivoting support portion (L) for pivotably supporting the second case (3) to the base (4) between a use position (P) in which the case body (1) is held to the base (4) by the holding portion (K) and a releasing retention position (Q) in which a holding state held by the holding portion (K) is released to enable the first case (2) and the second case (3) to be engageable/disengageable are formed.

20 Claims, 9 Drawing Sheets

U.S. PATENT DOCUMENTS

| | | | | |
|---|---|---|---|---|
| 5,445,703 | A * | 8/1995 | Steeves et al. | 156/544 |
| 5,597,000 | A * | 1/1997 | Gerber | 132/279 |
| 6,550,518 | B1 * | 4/2003 | Lee | 156/577 |
| 6,745,808 | B2 * | 6/2004 | Kobayashi | 156/577 |
| 2004/0129386 | A1 * | 7/2004 | Langerak | 156/522 |

FOREIGN PATENT DOCUMENTS

| | | | |
|---|---|---|---|
| JP | 10-045152 | A | 2/1998 |
| JP | 11-59076 | | 3/1999 |
| JP | 11-059076 | A | 3/1999 |
| JP | 2000-247095 | | 9/2000 |
| JP | 2000-247095 | A | 9/2000 |
| JP | 2002-178694 | | 6/2002 |
| JP | 2002-178694 | A | 6/2002 |
| JP | 2004-114471 | | 4/2004 |
| JP | 2004-114471 | A | 4/2004 |

OTHER PUBLICATIONS

Canadian Office Action dated Jul. 8, 2008 with reference to the corresponding Canada Patent Application No. 5,539,871.

* cited by examiner (a) Disassembled state (b) Assembled state

TRANSFER TOOL

TECHNICAL FIELD

The present invention relates to a refillable type transfer tool used for transferring a transfer material such as tape glue and correction tape to a transferred object such as paper.

BACKGROUND ART

Such kind of a transfer tool accommodates a transfer material made of coating film such as tape glue and correction tape in a case; and the transfer tool itself is pulled by a user's hand to a predetermined direction in a state where the transfer material is in contact with a transferred object such as paper surface so as to adhere the transfer material to the transferred object. Incidentally, in conventionally used transfer tools, there are an expendable type and a refillable type which leaves reusable parts after a transfer material is used up to replace with new consumable parts including a transfer material. More particularly, as for a refillable type transfer tool, there have been devised various types of transfer tools having cases configured by a half divided structure, in which a transfer material and feeding mechanism parts for feeding the transfer material outside the case are incorporated; and when the transfer tool is used up, the cases are separated to replace with new replacing parts (for example, refer to a patent document 1). The transfer tool disclosed in the patent document 1 has cases configured by a half divided structure (one is referred to as a first case; the other, a second case). The first case incorporates coating tape, a reel, and a transfer head; the second case incorporates mechanism parts such as gear; and the first case and the second case are in a fitted state and engaged by an engaging claw and a latching portion at a required point to assemble as an integrated case to be usable state as a transfer tool. On the other hand, the first case incorporating the coating tape or the like is considered as a cartridge, thereby enabling the cartridge to be replaced with a new one.

Patent Document 1: Japanese Patent Application Laid-Open Publication No. 2002-178694

DISCLOSURE OF THE INVENTION

Problems to be Solved by the Invention

However, in such a configured transfer tool, when force to which the transfer head is pressed to a transferred object such as paper in use is too strong and when force of user's hand griping the case in use is too strong because the case has a half divided fitting housing structure composed of the first case and the second case, deflection is generated in the case itself and unnecessary press force is exerted to the components disposed inside the case, and therefore, the transfer material cannot be appropriately fed to lose transferability. Furthermore, the first case and second case are fitted with each other and then engaged by the engaging claw and the latching portion; and therefore, it is difficult to assemble once separated first case and second case as an integrated case if correct positioning is not performed and operation of the positioning is troublesome.

In view of the foregoing problems, it is an object of the present invention to provide an excellent transferable and extremely usable transfer tool in which consumable supplies can be easily replaced while increasing rigidity in use and case assembling procedure is simple.

Means for Solving Problem

That is, according to the present invention, there is provided a transfer tool including: a case body for incorporating a transfer material; and a base capable of holding the case body, wherein the case body includes: a first case for holding replacement parts including at least the transfer material; and a second case engageable with and disengageable from the first case, for holding unchangeable parts constituting at least a part of feeding mechanism parts which feeds out the transfer material to a transferred object, the transfer tool further comprising: a holding portion for holding the case body to the base in a state where the first case and the second case are engaged; and a pivoting support portion for pivotably supporting the second case to the base between a use position in which the case body is held to the base by the holding portion and a releasing retention position in which a holding state held by the holding portion is released and the first case and the second case are engageable with and disengageable from each other.

According to the transfer tool having such a configuration, the first case and the second case constituting the decomposably assemblable case body are held to the base by the holding portion, thereby permitting the use position which is a usable state as the transfer tool; and therefore, rigidity and stability of the transfer tool increase and transferability of the transfer material to the transferred object and usability of the transfer tool can be increase. Furthermore, when replacement parts including the transfer material which are consumable supplies are replaced with new ones, the case body and the base are relatively pivoted by the pivoting support portion to be the releasing retention position, thereby disassembling the case body by releasing the engagement between the first case and the second case; and therefore, replacing operation of the replacement parts can be easily performed. More particularly, reusable unchangeable parts are held to the second case pivotably supported to the base, and replacement parts are held to the first case removable from the second case and the base; and therefore, replacement parts can be replaced as a whole first case with new ones and replacing operability can be further increased. Further, the second case does not need to be separated from the base in the releasing retention position, and only the first case can be replaced by separating from the second case; and therefore, loss of necessary parts can be effectively prevented. Still, when the first case is held to the base again in a state where the first case is engaged with the second case, the base and the case body are relatively pivoted by the pivoting support portion, thereby setting back the use position by the holding portion; and therefore, mutual positioning between the first case and the second case can be easily performed without applying a conventional engaging structure with an engaging claw and a latching portion between the first case and the second case.

More particularly, as for the holding portion having a structure capable of easily increasing rigidity of the transfer tool and easily assembling/disassembling the case body and base, there may be provided a fitting structure in which the first case and the second case are engageable with and disengageable from the base. More specifically, as for a structure of the holding portion capable of increasing rigidity of the transfer tool, there may be exemplified one in which the base is externally fitted on a predetermined region of the first base and the second base at the holding portion.

In the use position in which the case body is held to the base, in order to stabilize the use position without easily separating the case body and the base, there may be formed a latching portion for detachably latching the base and the case body in a state where the case body is held to the base by the holding portion. As for a simple structure of such the latching portion, it may be preferable that the latching portion is composed of a latching pawl formed on one of the base and the case body; and a latching hole formed on the other side, for detachably engaging with the latching pawl. More particularly, in order to be configuration so that the latching portion is automatically and appropriately operated when the base and the case body are relatively pivoted by the pivoting support portion between the use position and the releasing retention position, it may be preferable that the latching portion is composed of a latching pawl formed on one of the base and the second case; and a latching hole formed on the other side, for detachably engaging with the latching pawl.

In order to increase certainty of a holding state to the case body of the base by the holding portion, it may be preferable that a pivoting direction between the base and the second case by the pivoting support portion is different from an engaging/disengaging direction between the first case and the second case; and more preferably, the pivoting direction between the base and the second case by the pivoting support portion is substantially perpendicular to the engaging/disengaging direction between the first case and the second case.

Furthermore, in order to be a simple structure of the pivoting support portion, it may be preferable to be composed of a pivoting spindle formed on either the base or the second case; and a pivoting concave portion in which the pivoting spindle pivotably passes through. Further, it is considerable that the aforementioned unchangeable parts need to be replaced due to damage; and in the case where the base and the second case are made of different material, it is considerable that separation disposal is required; in such the case it is preferable that the base and the second case are a separable structure. Therefore, in order to respond to such mode, it is preferable that the pivoting spindle and the pivoting concave portion are engageable with and disengageable from each other in the releasing retention position and restricted to be engaged with and disengaged from each other by the holding portion in the use position.

In order to well maintain transfer performance by simple configuration even in the above-mentioned configuration, it may be preferable to include a transfer head, in which the case body puts the transfer material into contact with the transferred object; an opening is formed in the base, the opening being opened in the pivoting direction to the case body by the pivoting support portion; the transfer head is located in the opening in the use position; and, of the transfer head, a transfer surface which presses the transfer material to the transferred object, is protruded from the opening toward the transferred object side.

More particularly, when the transfer head is pressed against the transferred object from upper side and used in a mode where the transfer tool is held by hand in the air and pulled to a predetermined direction, there is a case where the transfer material snakes and is transferred to the transferred object. In order to solve such a problem and increase straightness of transfer, it is preferable that the transferred object is caught inside the transfer tool and is pulled to a predetermined direction. As for configuration of the transfer tool to realize such function, it may be preferable to include a transferred object receiver disposed on the side opposite to the case body of the base, for receiving the transferred object facing to the transfer surface of the transfer head in the use position, and a passing through space capable of passing the transferred object is formed between the transferred object receiver and the base; and the transfer surface of the transfer head is located in the passing through space. In this case, it may be configured that the transferred object receiver is integrally pivotable with the base to the case body by the pivoting support portion, thus it does not take away from replacing operability of the first case by providing the transferred object receiver.

Further, it may be configured to include a guide portion disposed on the transferred object receiver, for guiding the transferred object to the transfer surface of the transfer head, thereby increasing stability to the transfer tool of the transferred object in transfer. As for a preferable example of such a guide portion, there may be provided an auxiliary roller which is rotatable while being in contact with the transferred object from the side opposite to the transfer head. Furthermore, as a result of use, the guide portion is possibly contaminated, there may be configured that the guide portion is detachable to the transferred object receiver in the releasing retention position, thereby enabling the contaminated guide portion to be replaced with new ones. In addition, in the case where a transfer material receiver and the guide portion are made of different material, separation disposal thereof becomes easy.

Furthermore, as for the transfer head capable of realizing smooth transferability to the transferred object of the transfer material, there may be included a transfer roller for putting the transfer material into contact with the transferred object and feeding while rotating, and the transfer head including the transfer roller is held by the first case as a part of the replacement parts, thereby enabling the contaminated transfer head by use to be easily replaced.

Further, as for a preferable transfer material for use in such kind of the transfer tool, there may be provided coating film such as tape glue or correction tape to be adhered to the transferred object, the coating film being adhered to one surface of long tape body and forming band-shape having predetermined width within a width dimension of the transfer surface of the transfer head; and in this case, a winding off spool for feeding with the tape body attaching the transfer material with being wound and held and a rolling up spool for recovering with the tape body after adhering the transfer material to the transferred object with being wound and held, are held to the first case as a part of the replacement parts, whereby extremely simple replacing operation can be performed compared to the case where only the transfer material is replaced with replacement parts. Correspondingly, as for a preferable unchangeable parts to be held by the second case in the feeding mechanism parts, there may be exemplified one which are rotation drive parts for rotatably driving in conjunction with the winding off spool and the rolling up spool. As for more specifically preferable rotation drive parts, there may be included at least a winding off gear and a rolling up gear being respectively detachably engaged with the winding off spool and the rolling up spool, the winding off gear and the rolling up gear being engaged directly or indirectly.

In the transfer tool having the above described configuration, the holding portion may be a handheld region in which an operator holds by hand in use, thereby increasing rigidity of the transfer tool in use. Therefore, in the case where the holding portion is a fitting structure made up of the case body and the base and a handheld region, rigidity of the transfer tool in use can be remarkably improved.

Effects of the Present Invention

According to the present invention, the transfer tool has a structure in which the case body decomposable into the first case and the second case is held to the base through the holding portion, and an usable use position as the transfer tool is provided in the holding state; and therefore, rigidity in use can be increased compared to a transfer tool having a case of a merely half divided structure. As a result, deflection or the like generated in the case is reduced and released, thereby permitting to increase transfer performance. Furthermore, even if the first case and the second case are not engaged with an engaging claw or the like, the case body can be integrated by holding to the base by the holding portion; and therefore, the structure of the first case and the second case can be simplified.

More particularly, the second case is pivotably supported to the base by the pivoting support portion, and the base and the second case can be pivoted between the releasing retention position in which the first case and the second case are separatable or reassemblable and the use position in which the base holds the case body; and therefore, a state capable of assembling and disassembling the case body can be made by simple operation which is rotational operation. Then, unchangeable parts are held in the second case; on the other hand, replacement parts including the transfer material which is consumable supplies are held in the first case which is to be separated from the second case; and therefore, the first case attaching replacement parts can be directly replaced with new ones, thereby permitting to be usable state as the transfer tool again. Replacing operation of the first case also is not required to separate the second case and the base, and therefore, loss of necessary parts can be preferably prevented.

BEST MODE FOR CARRYING OUT THE INVENTION

An embodiment of the present invention will be described below with reference to the drawings.

Figure 1:
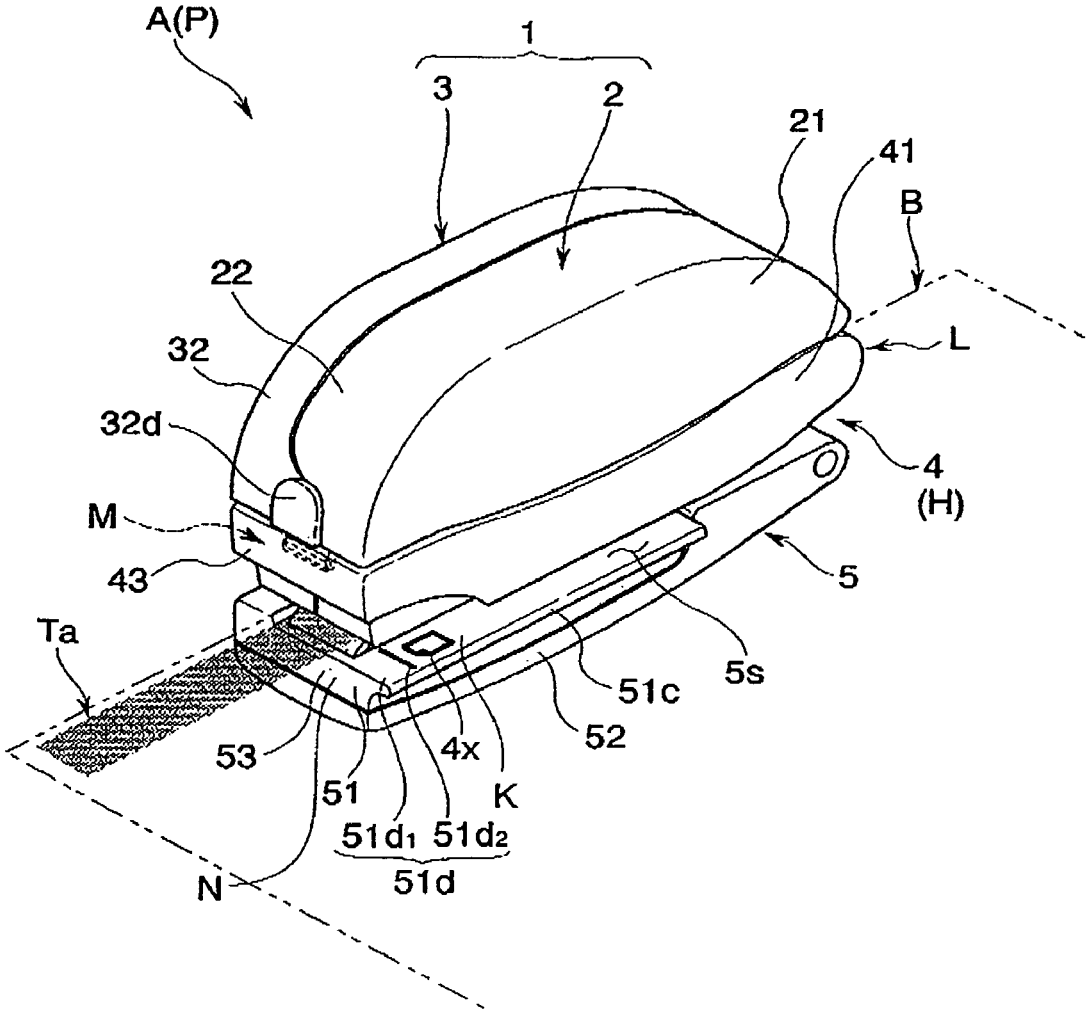
FIG. 1 is a perspective view showing a transfer tool in a use position according to an embodiment of the present invention.
Figure 2:
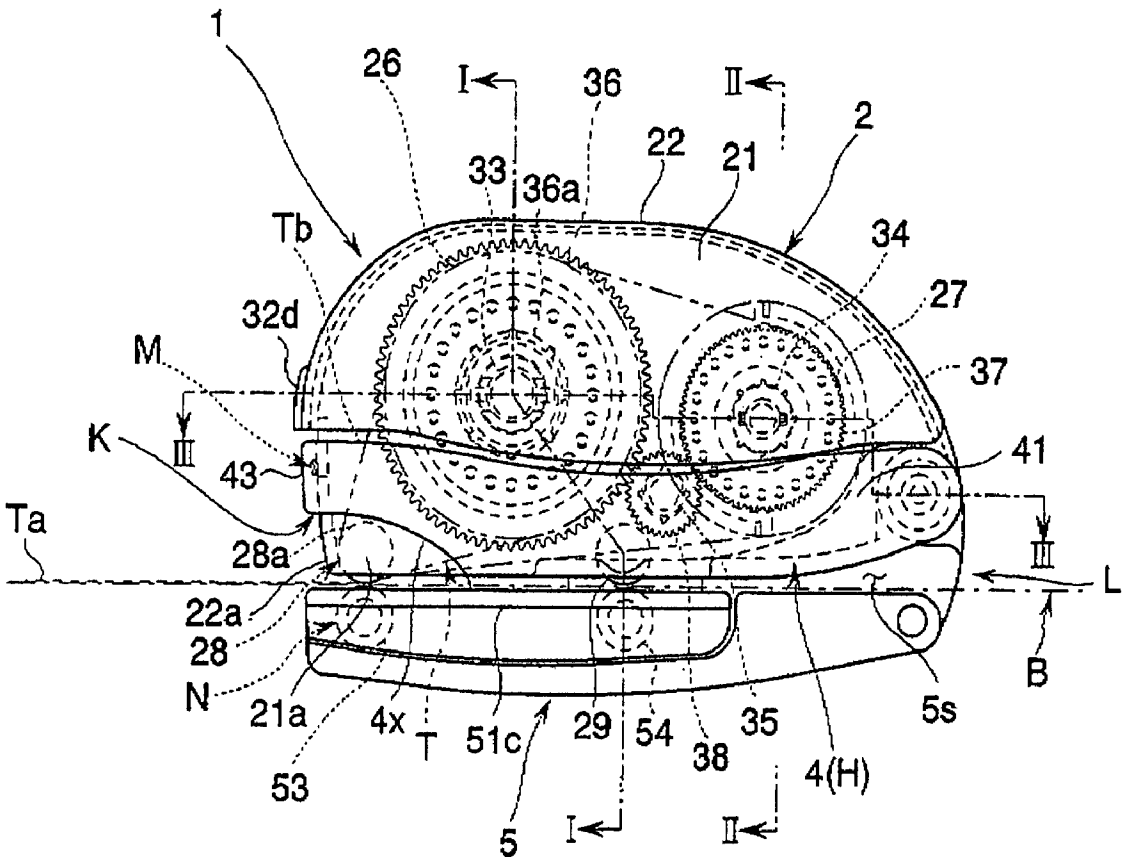
FIG. 2 is a right side view of the same.
Figure 3:
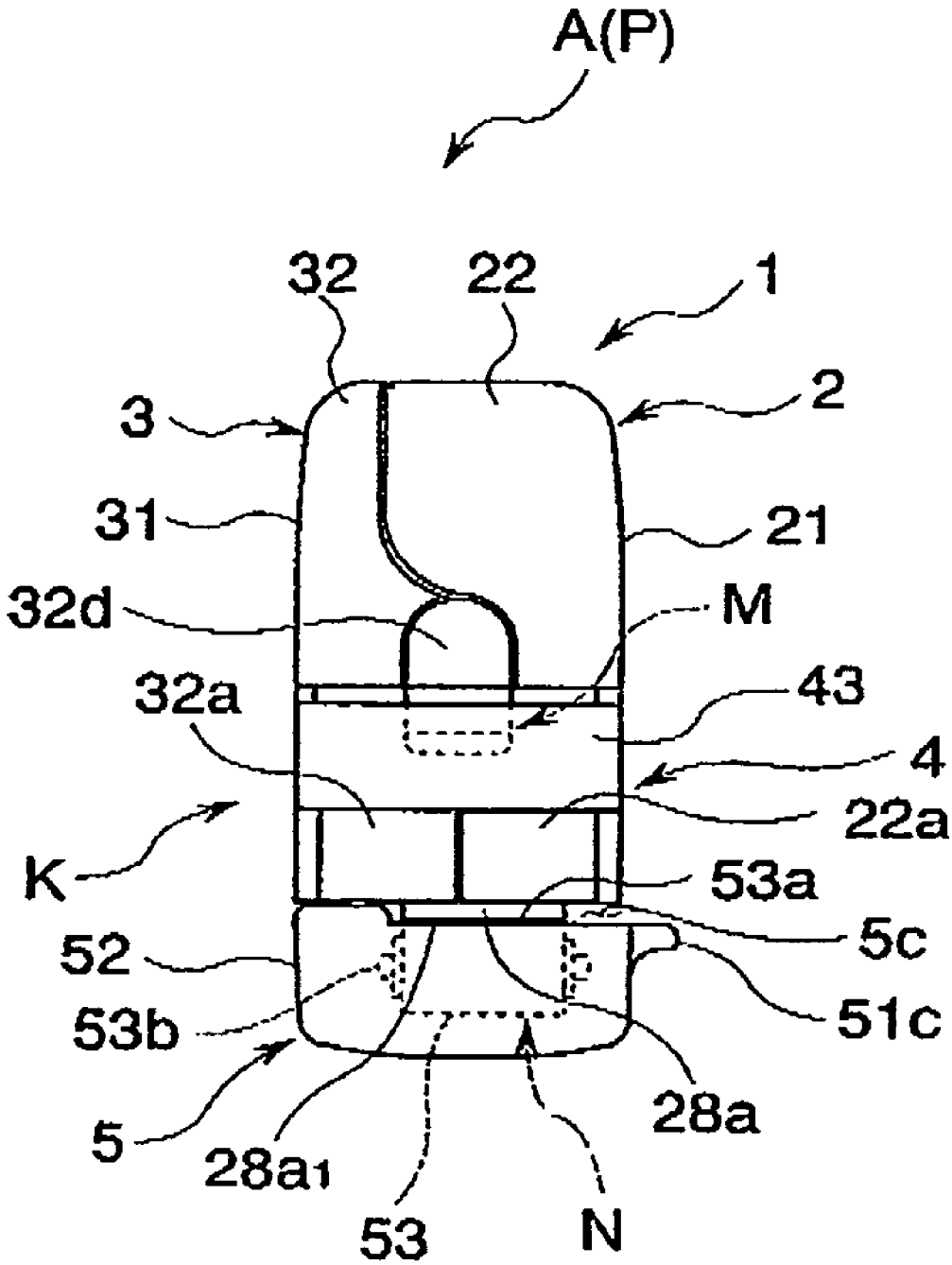
FIG. 3 is a front view of the same.
Figure 4:
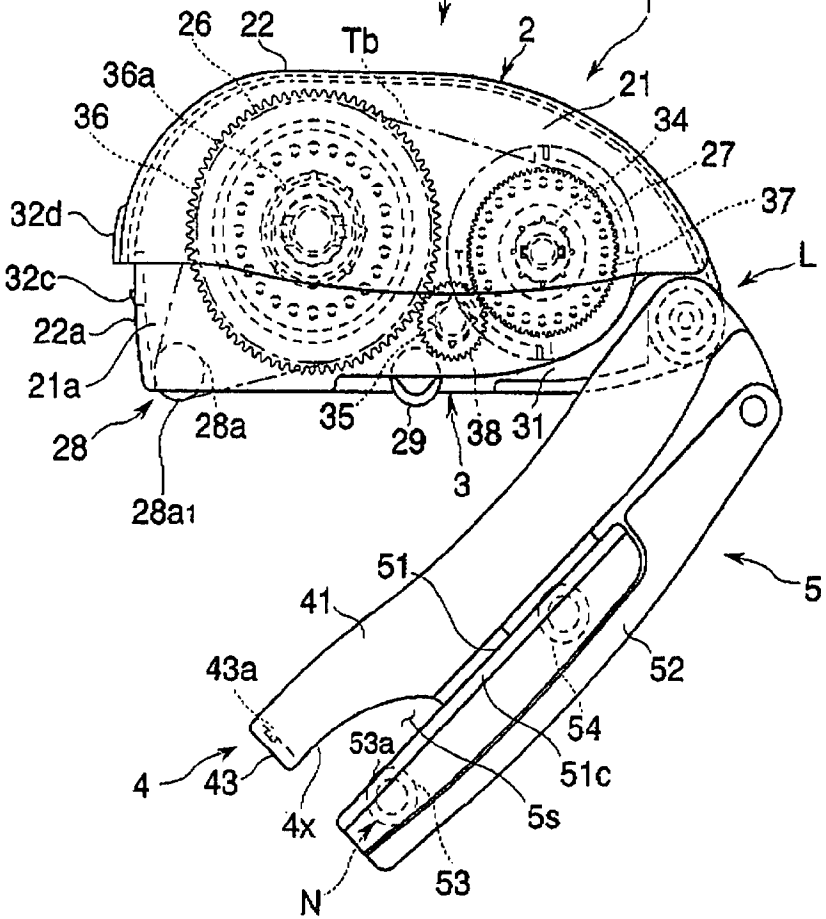
FIG. 4 is a right side view showing the same transfer tool in a releasing retention position.
Figure 5:
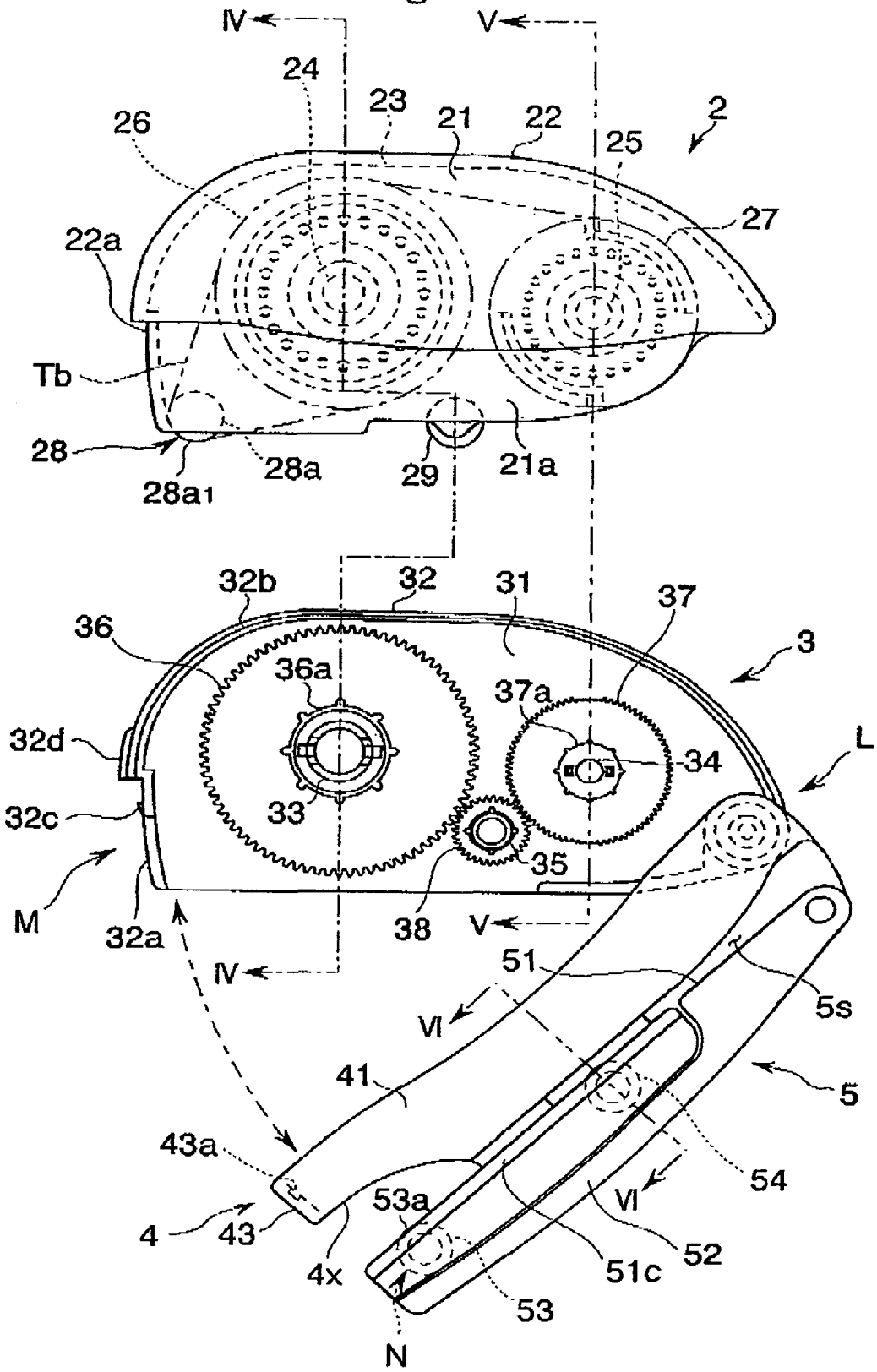
FIG. 5 is right side view showing the same transfer tool in the releasing retention position with a case body being disassembled state.

A transfer tool A of this embodiment shown in a perspective view of FIG. 1 adopts coating tape-shaped glue (referred to as "tape glue T" below) as a transfer material, and glue Ta of the tape glue T fed out a predetermined length at a time is used by adhering to the surface of a transferred object ("paper slip B" is used as an example in this embodiment, but it is not limited). In addition, the tape glue T is one in which the glue Ta is previously adhered to one surface of resin long and thin tape body Tb. In this embodiment, the transfer tool A includes the following main constituent components: a case body 1 which accommodates the glue Ta and feeding mechanism parts for feeding the glue out, a base 4 relatively pivotably provided to the case body 1 together with holding the case body 1, and a transferred object receiver 5 for holding the paper slip B with the base 4 when the glue Ta is transferred; and more particularly, the case body 1 is composed of a pair of cases (a first case 2 and a second case 3) which is substantially a half divided structure. More detail describing, the base 4 can maintain a use position P in which the transfer tool A is usable state by holding the case body 1 by a holding portion K; and more particularly, the base 4 is configured to pivotably supporting the second case 3 by a pivoting support portion L. In addition, a pivotable region of the base 4 and the second case 3 by the pivoting support portion L is set between the use position P shown in FIG. 1 and FIG. 2 (right side view) and FIG. 3 (front view) and a releasing retention position Q which is a state capable of separating and assembling the first case 2 and the second case 3 by releasing a holding state by the holding portion K as shown in FIG. 4 and FIG. 5 (both are right side views). Configuration and function of each part will be specifically described.

As shown in FIG. 1 to FIG. 5, the case body 1 is composed of the first case 2 and the second case 3 which are engageable with and disengageable from each other from both sides as described above. First, as shown in FIG. 5, FIG. 8A, FIG. 9, and FIG. 10, the first case 2 functions as a replacing cartridge and includes a side wall 21 which is an outer wall of one side (right side in this embodiment) of the case body 1; a circumference wall 22 continuing over a front end, a top end and a rear end of the side wall 21, and a plate shaped inner wall 23 arranged opposing to the side wall 21 and hidden within the case body 1 in a state assembled with the second case 3; and a lower end side is opened. In this embodiment, the first case 2 is a synthetic resin integrated molding. In the lower end side of the side wall 21, as particularly shown in FIG. 6 and FIG. 7, a bent portion 21*a* bending inward and drooping is formed over back and forth; and the lower end side at the front end side of the circumference wall 22 is continued to the bent portion 21*a* and bent inward (backward) to form a bent portion 22*a*. Furthermore, in an open end of the circumference wall 22, as shown in FIG. 6, FIG. 7, FIG. 9, and FIG. 10, a thin-walled portion 22*b* which is thin so as to be fit to the second case 3 is formed. Further, substantially horizontally extending axes 24 and 25 are protruded at the front end side and the rear end side in the inside surface of the side wall 21; a winding off spool 26 which holds the tape glue T in unused state in a wound state is rotatably supported on the axis 24 at the front end side; and a rolling up spool 27, in which the tape body Tb after transferring the glue Ta is rewound to wind and hold, is supported on the axis 25 at the rear end side. The winding off spool 26 and the rolling up spool 27 are rotatably supported to each opening edge of round holes 23*a* and 23*b* formed at the front end side and the rear end side of the inner wall 23. Furthermore, as shown in FIG. 2 to FIG. 5 and FIG. 8(*a*) and (*b*), a transfer head 28 is mounted at a front end of the first case 2 by protruding from a lower side opening. Specifically, the transfer head 28 is composed of a supporting axis 28*b* supported between front ends of the side wall 21 and the inner wall 23 and a transfer roller 28*a* rotatable with the supporting axis 28*b* or to the supporting axis 28*b*. Therefore, the tape glue T extracted from the winding off spool 26 is via a downward surface (the relevant surface is referred to as a transfer surface $\mathbf{28}a_1$) of the transfer roller 28*a* from the lower side; only the glue Ta is coated from the transfer surface $\mathbf{28}a_1$ to the paper slip B; and only the tape body Tb is recovered from the transfer roller 28*a* to the rolling up spool 27 in a wound state passing the upper side of the winding off spool 26. Then, in a state where replacement parts, which includes the tape glue T being consumable parts and the feeding mechanism parts such as the winding off spool 26, the rolling up spool 27, and the transfer head 28, are attached to the first case 2, the replacement parts are replaced with new ones.

The second case 3 is the other constituent elements of the case body 1, which is configured so that only the first case 2 can be replaced in a state where it is not generally separated from the base 4 and the transferred object receiver 5, and holds unchangeable parts being a part of the feeding mechanism parts for supplying the tape glue T to the paper slip B. Specifically, as shown in FIG. 1 to FIG. 3, and FIG. 5 to FIG. 10, the second case 3 is composed of a side wall 31 which companions to the side wall 21 of the first case 2 to constitute an outer wall (left side) of the case body 1; and a circumference wall 32 which continues over a front end, a top end, and a rear end of the side wall 31 so as to make a pair of the circumference wall 22 of the first case 2, and a lower end side is opened. In this embodiment, the second case 3 is also a synthetic resin integrated molding. In the lower end side of the side wall 31, as particularly shown in FIG. 6 and FIG. 7, a bent portion 31*a* bending inward and drooping is formed over back and forth so as to make a pair of the bent portion 21*a* of the first case 2; and the lower end side at the front end side of the circumference wall 32 is continued to the bent portion 31*a* and bent inward (backward) to form a bent portion 32*a*, as in the bent portion 22*a* at the circumference wall 22, of the first case 2. In an open end of the circumference wall 32, as shown in FIG. 6, FIG. 7, FIG. 9, and FIG. 10, a thin-walled portion 32*b* which is thin so as to be fit to the first case 2 is formed. That is, the first case 2 and the second case 3 are configured so as to be engageable with and disengageable from each other by the fitting relationship of the thin-walled portions 22*b* and 32*b* of the respective circumference walls 22 and 32. Furthermore, as shown in FIG. 5, substantially horizontally extending axes 33, 34, and 35 are protruded at the front end side and the rear end side in the inside surface of the side wall 31 and at the middle position thereof; a winding off gear 36 is rotatably supported at the axis 34 of the front end side and the winding off spool 26 is configured so as to be driven and rotated by a winding off core 36*a* which mounted to the winding off gear 36; a rolling up gear 37, in which a rolling up core 37*a* for rotatably driving the rolling up spool 27 is integrally attached, is rotatably supported at the axis 34 of the rear end side; and an intermediate gear 38, which is engaged to both the winding off gear 36 and the rolling up gear 37 and synchronizes their rotational operation, is rotatably supported at the axis 35 of the middle position. Of the feeding mechanism parts of the glue Ta, the winding off gear 36, the rolling up gear 37, and the intermediate gear 38 are treated as the unchangeable parts. In addition, it can be elastically urged between the winding off gear 36 and the winding off core 36*a* by appropriate means (not shown in the drawing) such as a spring which presses the winding off core 36*a* to the winding off spool 26 side. In this case, slip of the winding off spool 36 and dissipation of transfer tape T with the slip can be prevented by friction force generated between the winding off core 36*a* and the winding off spool 26. Furthermore, as shown in FIG. 1, FIG. 2, FIG. 5 and FIG. 11, a first pivoting axis 39, which is a pivoting spindle for pivotably connecting the second case 3 to the base 4, is substantially horizontally protruded in the rear end of the inner side surface of the side wall 31. The first pivoting axis 39 forms hollow shape piercing through both sides (extrusion direction) and is communicated to a concave portion 31*b* opened in the rear end of the outer side surface of the side wall 31. Further, as clearly shown in FIG. 4 and FIG. 5, an adunc latching pawl 32*c* protruding frontward and a press button 32*d* for bending the latching pawl 32*c* in the back and forth direction by elastic deformation by pressing from the front side are formed in the front end of the circumference wall 32. In addition, the press button 32*d* is formed by partly thickening the circumference wall 32.

Figure 6:
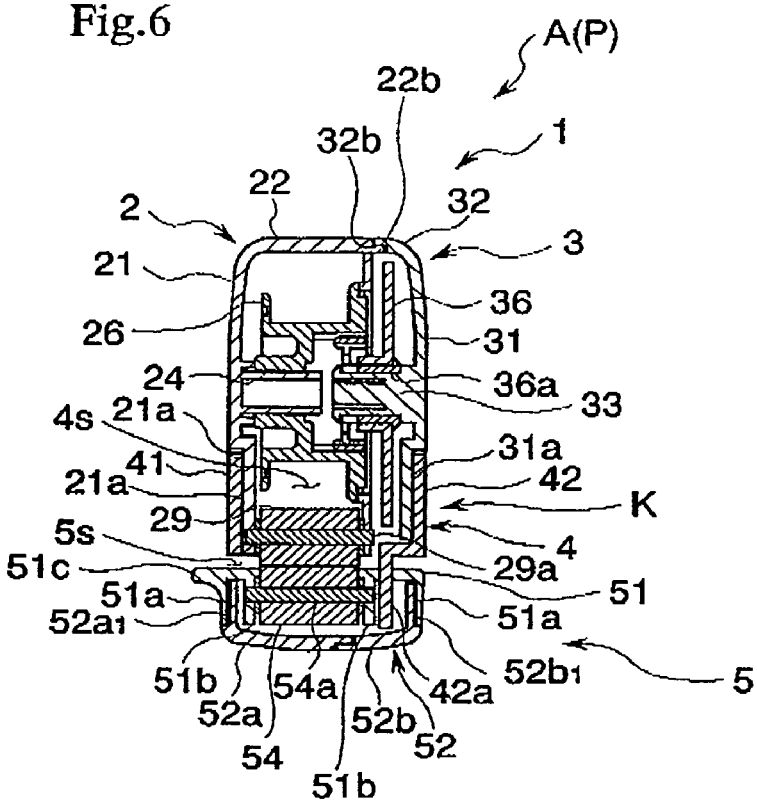
FIG. 6 is a schematic sectional view taken along the line I-I shown in FIG. 2.
Figure 7:
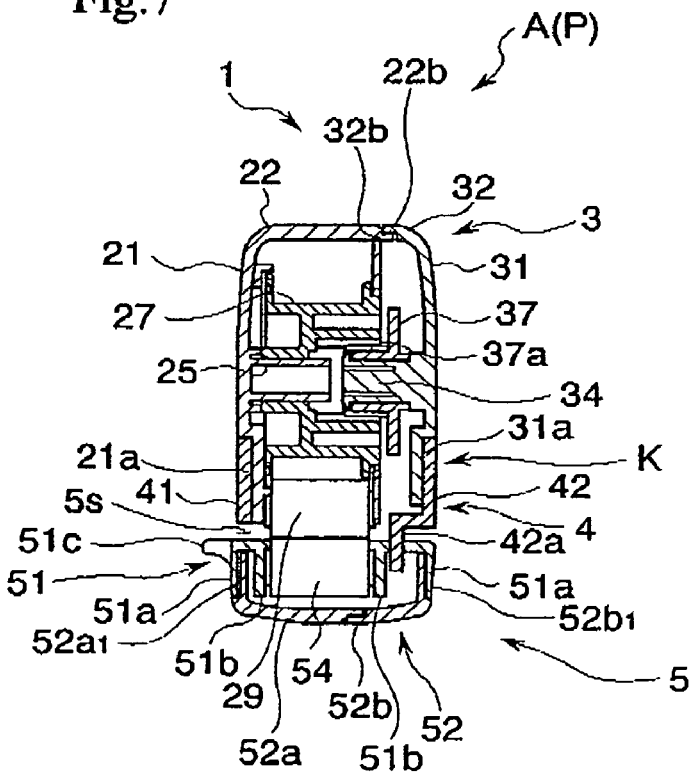
FIG. 7 is a schematic sectional view taken along the line II-II shown in FIG. 2.
Figure 8:
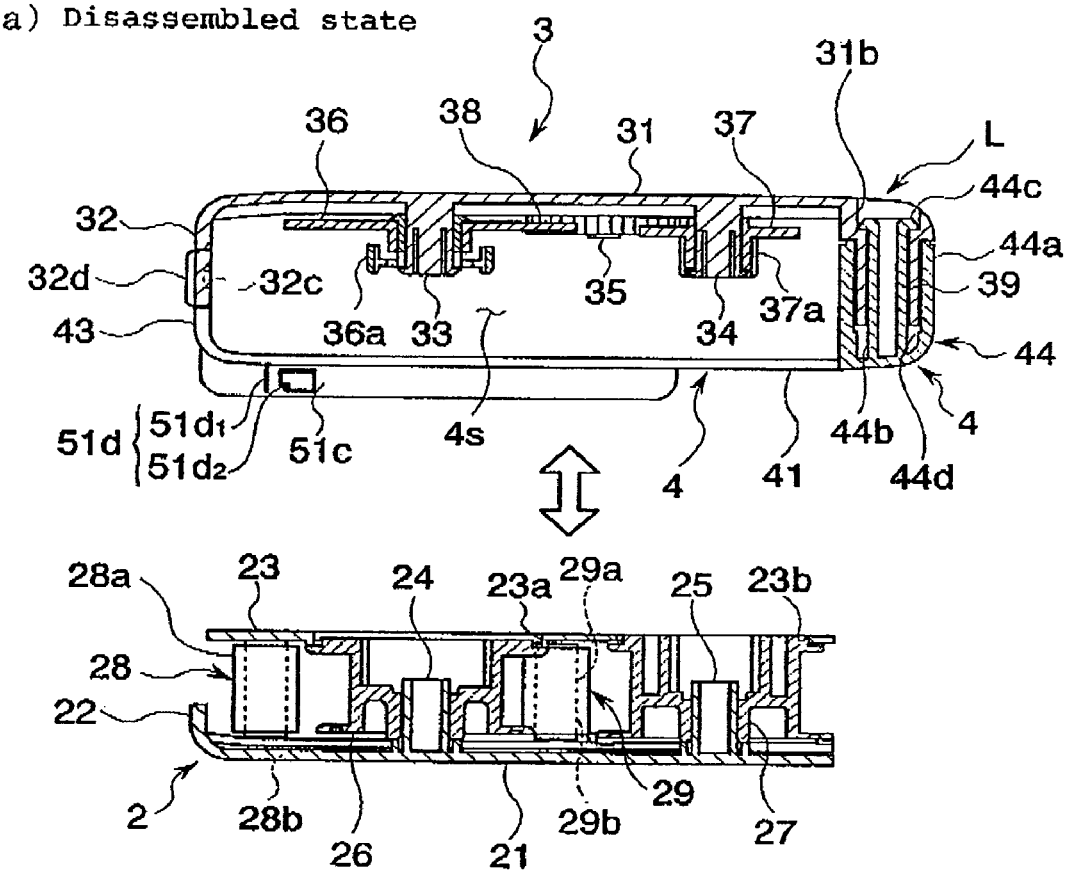
FIG. 8 is schematic sectional views taken along the line III-III shown in FIG. 2.
Figure 8:
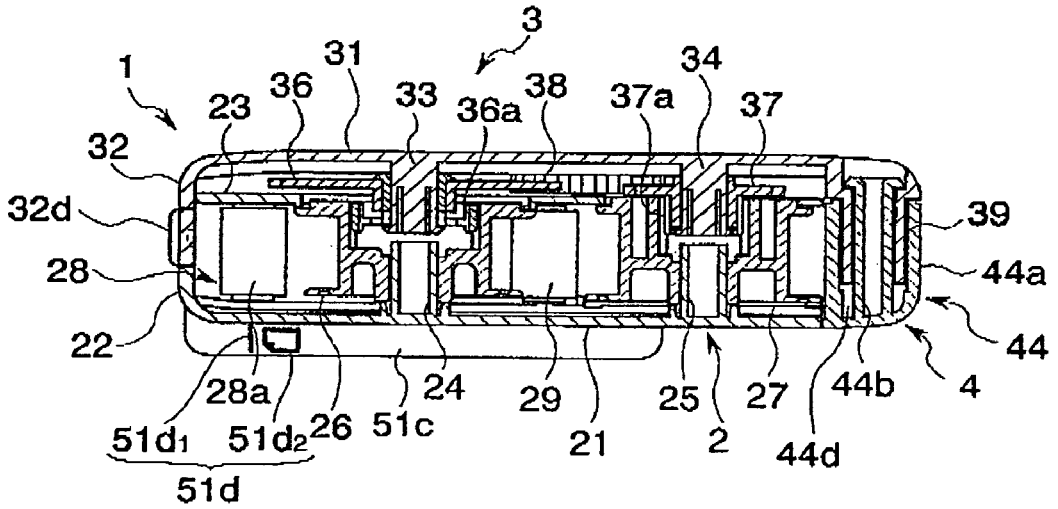
Figure 9:
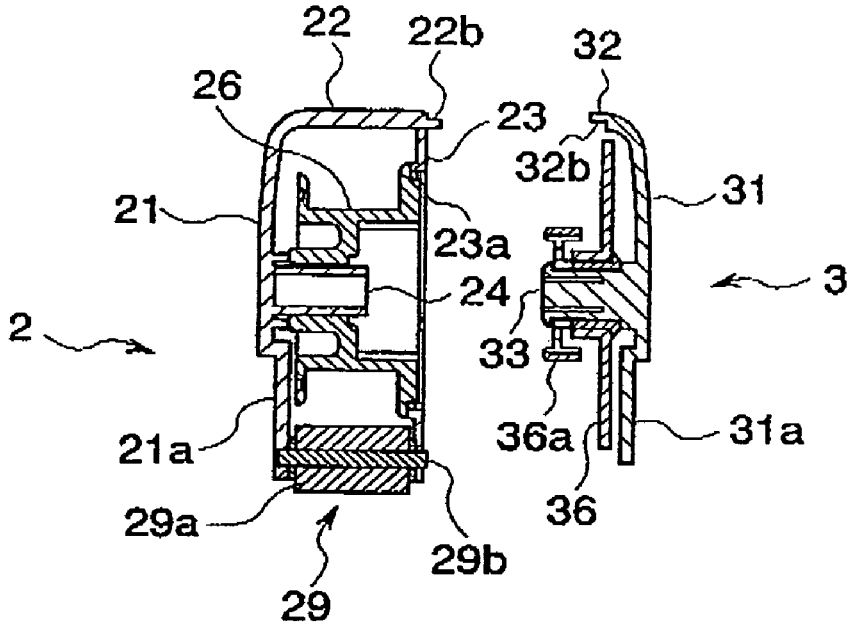
FIG. 9 is a schematic sectional view taken along the line IV-IV shown in FIG. 5.
Figure 10:
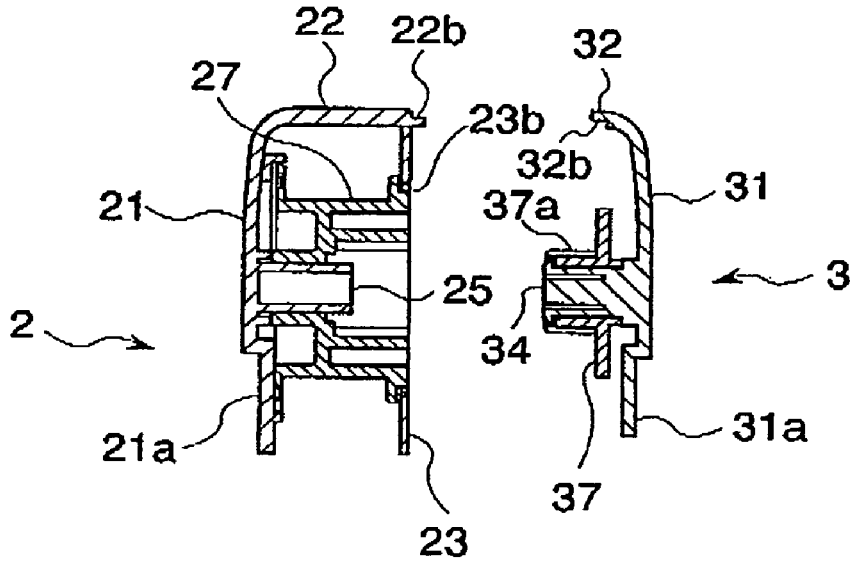
FIG. 10 is a schematic sectional view taken along the line V-V shown in FIG. 5.
Figure 11:
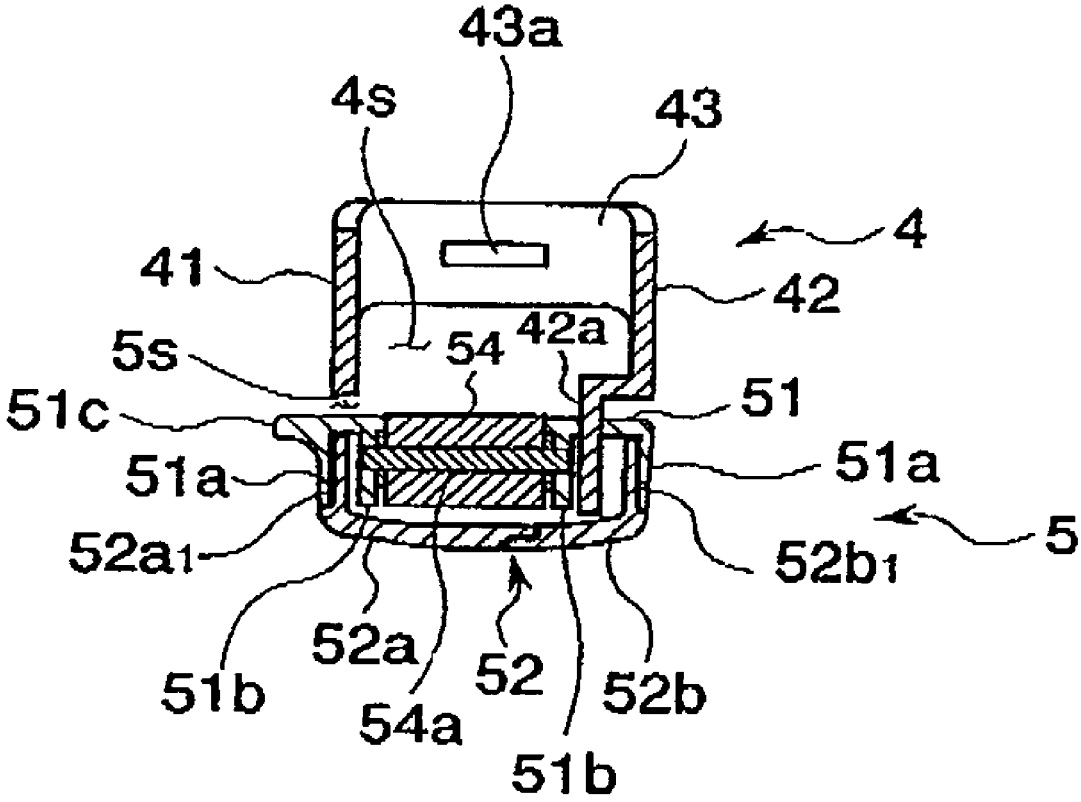
FIG. 11 is a schematic sectional view taken along the line VI-VI shown in FIG. 5.

The base 4 includes function of the use position P capable of using the transfer tool A by holding in a state where the first case 2 and the second case 3 are fitted each other in the case body 1 and function of the releasing retention position Q capable of disassembling the case body 1 into the first case 2 and the second case 3. Specifically, as shown in FIG. 1 to FIG. 7, the base 4 is mainly composed of plate shaped side walls 41 and 42 formed on each side and a plate shaped front wall 43 for linking front ends between the side walls 41 and 42 to provide frame shaped configuration formed with an opening 4*s* continuously opened up and down. In this embodiment, the side walls 41 and 42 and the front wall 43 adopt synthetic resin integrated molding which is thicker in thickness and higher in rigidity than those of the first case 2 and the second case 3. The right side wall 41 and the left side wall 42 have approximately the same longitudinal dimension as the case body 1 and substantially the same shape in appearance to be opposedly arranged, and externally fitted to the bent portions 21*a* and 31*a* at the respective side walls 21 and 31 of the first case 2 and the second case 3 in the use position P; and the front wall 43 is externally fitted to the bent portions 22*a* and 32*a* of the respective circumference walls 22 and 32. At this time, the side walls 41 and 42 and the front wall 43 are substantially the same plane as those of the side walls 21 and 31 of the first case 2 and the second case 3 and the front end sides of the circumference walls 22 and 32, respectively. That is, the base 4 is configured to be placed within the opening 4*s* to be externally fitted to the case body 1, thereby constituting the holding portion K for holding by the base 4 so that the case body 1 is not disassembled into the first case and the second case 3. In addition, a cutout portion 4*x* is formed in the front end of the base 4 with cut in bent shape seen from side view in order not to lose transfer function by protruding a part of the transfer head 28 (specifically, at least the transfer surface $28a_1$ of the transfer roller 28*a*) from the front end of the base 4 which holds the case body 1 by the holding portion K. Furthermore, as shown in FIG. 6, FIG. 7, and FIG. 11, in order to assemble the transferred object receiver 5 to be described later, the end portion of one (left side) side wall 42 is once bent inward and extended downward more than the other (right side) side wall 41, thereby forming an extending wall 42*a*. Further, the base 4 pivotably supports the second case 3. As configuration for that, as shown in FIG. 8(*a*) and (*b*), at the inner surface of one (right side) side wall 41 of the base 4, a second pivoting axis 44, which relatively pivotably supports the first pivoting axis 39 formed at the side wall 31 of the second case 3, is formed by protruding. The second pivoting axis 44 has a double cylindrical structure including an outer cylindrical portion 44*a* externally fitted to the first pivoting axis 39 and an inner cylindrical portion 44*b* internally fitted to hollow inside of the first pivoting axis 39; an air gap between the both cylindrical portions 44*a* and 44*b* serves as a pivoting concave portion 44*d*; an engaging claw 44*c* bent outward at the protruded end of the inner cylindrical portion 44*b* is engaged in the concave portion 31*b* opened at the side wall 31 of the second case 3. Such configuration constitutes the pivoting support portion L for pivotably supporting the second case 3 to the base 4. Furthermore, as shown in FIG. 5 and FIG. 5, in the inner side of the front wall 43, a latching hole 43*a* which is engageable with and disengageable from the latching pawl 32*c* in back and forth direction, formed on the circumference wall 32 of the second case 3 in the use position P; and this engagement relationship between the latching pawl 32*c* and the latching hole 43*a* constitutes a latching portion M. Accordingly, relative pivotal operation between the base 4 and the case body 1 based on the pivoting support portion L is performed between the use position P, in which the latching portion M is in a latched state by overviewing the base 4 in the holding portion K to the case body 1 configured by combining the first case 2 and the second case 3; and the releasing retention position Q in which the case body 1 is capable of being disassembled into the first case 2 and the second case 3 or reassembled by performing that the latching portion M is in a released state and the base 4 is placed downward of the case body 1.

The transferred object receiver 5 is for permitting the glue a to transfer in a state where the paper slip B being the transferred object is held between the transferred object receiver 5 and the base 4 and configured so as to be pivotable to the case body 1 with the base 4. Specifically, as shown in FIG. 1 to FIG. 7, the transferred object receiver 5 is a resin hollow member mainly composed of a top wall 51 in which a passing through space 5*s* having a predetermined height is formed over back and forth between the lower end of the base 4 for passing the paper slip B; and a boat-shaped housing 52 for supporting the top wall 51. Further, as shown in FIG. 6, FIG. 7, and FIG. 11, the housing 52 is configured so that a first lower wall 52*a* and a second lower wall 52*b*, which are a substantially half divided structure on either side and capable of assembling and disassembling, are engageable with and disengageable from each other; and perpendicular pieces 51*a* and 51*a* drooped from the right and left ends of the top wall 51 are respectively externally fitted to uprising pieces $\mathbf{52}a_1$ and $\mathbf{52}b_1$ uprising from the respective ends of the first lower wall 52*a* and the second lower wall 52*b* to assemble as the integrated transferred object receiver 5. Furthermore, both are integrally assembled at a part of the top wall 51 by passing the extending wall 42*a* of the base 4 from the upper side by appropriate means such as engagement so that the transferred object receiver 5 pivots to the case body 1 integrally with the base 4. That is, by such configuration, the passing through space 5*s* is opened to the back and forth and the other side (right side) except one side (left side) closed by the extending wall 42*a* of the base 4; one side of the paper slip B passed through the passing through space 5*s* is pressed against the inner surface of the extending wall 42*a* and guided from the rear end side to the front end side, whereby the glue Ta can be straightly transferred to the paper slip B. In addition, in the transfer roller 28*a* of the transfer head 28, at least the transfer surface $\mathbf{28}a_1$ is placed in the passing through space 5*s*. Further, as shown in FIG. 1 to FIG. 8 and FIG. 11, in order to secure stability of the inserted paper slip B into the passing through space 5*s*, the top wall 51 forms an extending wall 51*c* extending to the side (left side) of the open side of the passing through space 5*s*; and the upper surface of the extending wall 51*c* is formed to the same level as that of the top wall 51 to support the paper slip B by also the extending wall 51*c* and to easily insert the paper slip B into the passing through space 5*s*. Further, means for indicating transfer start position 51*d* for indicating a transfer start position of the glue Ta to the paper slip B is provided on the upper surface of the extending wall 51*c*. The means for indicating transfer start position 51*d* is composed of a line for indicating transfer start position $\mathbf{51}d_1$ provided on a position substantially along the extending line of the supporting axis 28*b* of the transfer roller 28*a* in the upper surface of the extending wall 51*c*, and arrangement procedure indication $\mathbf{51}d_2$ provided just behind the line for indicating transfer start position $\mathbf{51}d_1$. The line for indicating transfer start position $\mathbf{51}d_1$ and the arrangement procedure indication $\mathbf{51}d_2$ in this embodiment are slightly incused on the upper surface of the extending wall 51*c*; a straight line is used as the line for indicating transfer start position $\mathbf{51}d_1$ and shape of the paper slip B is used as the arrangement procedure indication $\mathbf{51}d_2$; however, these may be printed on the upper surface of the extending wall 51*c* or sticker may stick. This suggests certain transfer operation and error-free use direction to a user. Furthermore, inner walls 51*b* and 51*b* paired on either side and drooped at the inner side of both perpendicular walls 51*a* and 51*a* are formed on the top wall 51. A guide portion N for guiding so as to press the paper slip B to the transfer surface $\mathbf{28}a_1$ of the transfer roller 28*a*, is provided on the front end side between the inner walls 51*b* and 51*b*. As shown in FIG. 1 to FIG. 5 and FIG. 8, the guide portion N is configured by an auxiliary roller 53 having a supporting axis 53*b* rotatably supported between the inner walls 51*b* and 51*b* at a position faced to the transfer surface $\mathbf{28}a_1$ of the transfer roller 28 from the lower side; the upper surface of the auxiliary roller 53 serves as a backing surface 53*a* and the auxiliary roller 53 is rotated in a predetermined direction while the backing surface 53*a* is pressed against the rear surface of the paper slip B, whereby transfer of the glue Ta by the transfer roller 53 is securely performed while the paper slip B is fed out in a predetermined direction. In addition, as shown in FIG. 2 to FIG. 9 and FIG. 11, a second bottom auxiliary roller 54, which is supported by a supporting axis 54*a* and pressed against the paper slip B from the lower side as in the auxiliary roller 53, is rotatably provided in the vicinity of the center portion of the inner walls 51*b* and 51*b*; on the other hand, a second top auxiliary roller 29, which is pressed against the upper surface of the paper slip B by protruding from the lower opening, is rotatably provided in the vicinity of the center portion of the first case 2 opposed to the second bottom auxiliary roller 54 from the upper side. The second top auxiliary roller 29 is rotatably supported by a supporting axis 29*a* which is rotatably supported between the side wall 21 of the first case 2 and the inner wall 23. Therefore, the second top auxiliary roller 29 and the second bottom auxiliary roller 54 exhibits paper feeding function in which the paper slip B is sandwiched above and below and fed in a predetermined direction. In addition, the auxiliary roller 53 and the second bottom auxiliary roller 54 are detachable by disassembling the top wall 51 and the housing 52 of the transferred object receiver 5. In addition, the second top auxiliary roller 29 can be provided to the base 4, not to the first case 2, by appropriate means; and doing so, the second top auxiliary roller 29 is not a constituent element of replacement cartridge, but it may be unchangeable parts.

As described above, the transfer tool A in this embodiment can be the use position P by making the case body 1, which is configured by the half divided structure composed of the first case 2 and the second case 3 which are engageable with and disengageable from each other, hold to the base 4 in the holding portion K; and therefore, compared to a known transfer tool having a case body of a merely half divided structure, rigidity of the transfer tool A in use is increased, strain and unnecessary force are not exerted to the internal mechanism parts, and good transferability can be obtained. Furthermore, the base 4 pivotably supports the second case 3 in the pivoting support portion L; the second case 3 accommodates unchangeable parts of the feeding mechanism parts of the tape glue T being the transfer material; on the other hand, the first case 2 which is removable from the second case 3 accommodates the tape glue T and replacement parts. Therefore, it is possible to easily replace old and new first case 2 as a replaceable cartridge, which is the first case 2 attaching the tape glue T and replacement parts, in the releasing retention position Q in which the holding state to the case body 1 of the base 4 by the holding portion K is released.

More particularly, in this embodiment, the holding portion K is configured by a fitting structure between the base 4 and the case body 1 and, more specifically, the base 4 is configured to externally fit to the case body 1, whereby rigidity of the transfer tool A in use is extremely increased; further, the base 4, which holds the case body 1 in the use position P, serves as a hand-held region H in use, whereby strain of the case body 1 can be further prevented.

Furthermore, the latching portion M, which engages the case body 1 and the base 4 in a state where the case body 1 is held to the base 4 by the holding portion K in the use position P, is formed, whereby stability of the transfer tool A in the use position P can be increased. More particularly, the latching portion M is an engagement structure in which the latching pawl 32*c* formed in the case body 1 and the latching hole 43*a* formed in the base 4 are engageable with and disengageable from each other, whereby configuration of the latching portion M itself can be simplified. More particularly, the latching pawl 32*c* is formed in the second case 3, and therefore a latching pawl is not required to be made in the replacement first case 2 and cost of the first case 2 can be reduced.

Further, pivoting directions between the case body 1 and the base 4 by the pivoting support portion L are different from engaging/disengaging directions between the first case 2 and the second case 3 in the releasing retention position Q, and more specifically, these both directions are substantially orthogonal, whereby the first case 2 and the second case 3 are not easily separated in the use position P.

Further, such the pivoting support portion L is an engagement structure in which the first pivoting axis 39 being the pivoting spindle formed in the second case 3 and the second pivoting axis 44 having the pivoting concave portion 44*d* formed in the base 4 are mutually pivotable, whereby smooth and stabilized pivotal operation between the case body 1 and the base 4 in the use position P can be realized. In addition, the first pivoting axis 39 and the second pivoting axis 44 are dismovable by the existence of the holding portion K in the use position P but are engageable with and disengageable from each other in the releasing retention position Q; and therefore, even when the second case 2 and the base 4 need to be segregated for disposal, both can be easily disassembled.

Furthermore, the base 4 forms the opening 4*s* opened in the pivoting direction to the case body 1 and accommodates the transfer head 28 provided in the case body 1 in order to transfer the glue Ta to the paper slip B in the opening 4*s* in the use position P, and the transfer surface $\mathbf{28}a_1$ of the transfer head 28 is protruded downward, that is, to the paper slip B side, from the opening 4*s*; and therefore, transfer of the glue Ta to the paper slip B can be securely performed.

Here, the transfer head 28 has the transfer roller 28*a* for transferring the glue Ta of the tape glue T with a long tape shape to the paper slip B by rotation operation; the transfer head 28 including the transfer roller 28*a* which tends to be contaminated as a result of use are held in the first case 2 as replacement parts. Therefore, a newly replaced first case 2 is attached with a clean state transfer roller 28; thus, not only good usability can be maintained but also extremely troublesome winding operation in which the tape glue T is wound to the transfer head 28 can be avoided, compared to the case where only the tape glue T is replaced. Further, the winding off spool 26 and the rolling up spool 27 by which the tape glue T is wound and maintained are held in the first case 2 as replacement parts, and therefore, simple replacement operation can be realized compared to the case where only the tape glue T is replaced. On the other hand, the winding off gear 36, the rolling up gear 37, and the like by which the winding off spool 26 and the rolling up spool 27 are driven and rotated are held in the second case 3 as unchangeable parts, and these can be generally repeatedly used; thus, waste of resources can be avoided and cost can be reduced.

Further, the transfer tool A in this embodiment includes the transferred object receiver 5 for forming the passing through space 5*s* in which the paper slip B is sandwiched between the transferred object receiver 5 the base 4 and the transfer surface $\mathbf{28}a_1$ of the transfer roller 28*a* is placed in the passing through space 5*s*; and therefore, transfer operation can be stably performed in a position where the paper slip B is sandwiched above and below. Then, the transferred object receiver 5 is pivotable to the case body 1 together with the base 4, and therefore, the presence of the transferred object receiver 5 is not obstacle to replacement operation of the first case 2.

More particularly, the guide portion N for guiding the paper slip B sandwiched into the passing through space 5*s* to the transfer head 28 side is formed in the transferred object receiver 5, and therefore, transferability of the glue Ta to the paper slip B is improved. Further, the guide portion N serves as the auxiliary roller 53 which rotates by being pressed against the paper slip B from the rear surface side, and therefore, feeding out to a forward direction of the paper slip B in transfer can be correctly performed. In addition, it is considerable that the auxiliary roller 53 is also contaminated or damaged depending on use conditions as in the transfer roller 28*a*, but the auxiliary roller 53 can adopt detachable configuration from the transferred object receiver 5; in such the case, the auxiliary roller 53 can be also replaced and very convenient.

In addition, it is needless to say that the present invention is not limited to the aforementioned embodiment. For example, a transfer tool which has not the transferred object receiver 5, that is, a transfer tool may be embodied so that a transfer tool in hand presses the transfer head from the upper side to the paper slip B to transfer the glue Ta without sandwiching the paper slip B. Furthermore, even when including the transferred object receiver 5, it is possible to transfer to not only the paper slip B but also various kinds of thickness of objects to be transferred by appropriately setting opening width in up and down direction of the passing through space 5*s* formed between the transferred object receiver 5 and the base 4. That is, a transferred object intended by the present invention is not limited to the aforementioned paper slip B, but various kinds may be applicable; as for a transfer material, various kinds such as correction tape or the like if it is transferable to the transferred object may be adopted other than the tape glue T. Other specific configurations of each part are not limited to the aforementioned embodiment, and various modifications may be made without departing from the spirit or scope of the present invention.

INDUSTRIAL APPLICABILITY

If the present invention is used, it is configured that the case body which can be disassembled into the first case and the second case is held to the base through the holding portion and a usable use position as the transfer tool is made in the holding state; and therefore, rigidity in use can be increased, compared to a transfer tool having a case of a merely half divided structure, so that deflection or the like generated in the case can be reduced and eliminated to increase transfer performance. Furthermore, the first case and the second case can be integrated with the case body by being held to the base by the holding portion without engaging by an engaging claw or the like, and therefore, a structure of the first case and the second case can be simplified.

The invention claimed is:

1. A transfer tool comprising:

a case body for incorporating a transfer material; and a base capable of holding the case body, wherein the case body includes:

a first case for holding replacement parts including at least the transfer material; and a second case engageable with and disengageable from the first case, for holding unchangeable parts constituting at least a part of feeding mechanism parts which feeds out the transfer material to a transferred object, wherein the transfer tool further comprising:

a holding portion for holding the case body to the base in a state where the first case and the second case are engaged; and a pivoting support portion for pivotably supporting the second case to the base between a use position in which the case body is held to the base by the holding portion and a releasing retention position in which a holding state held by the holding portion is released and the first case and the second case are engageable with and disengageable from each other, wherein the base is pivotably connected to the second case by the pivoting support portion such that the second case and the entire base are pivotably movable relative to each other about a pivot axis, wherein the case body further comprises a transfer head putting the transfer material into contact with the transferred object, and wherein an opening is formed in the base, the opening being opened in the pivoting direction to the case body by the pivoting support portion; the transfer head is located in the opening in the use position; and, of the transfer head, a transfer surface which presses the transfer material to the transferred object, is protruded from the opening toward the transferred object side.

2. The transfer tool according to claim 1, wherein the holding portion has a fitting structure in which the first case and the second case are engageable with and disengageable from the base.

3. The transfer tool according to claim 2, wherein the base is externally fitted on a predetermined region of the first base and the second base at the holding portion.

4. The transfer tool according to claim 1, further comprising a latching portion for detachably latching the base and the case body in a state where the case body is held to the base by the holding portion.

5. The transfer tool according to claim 4, wherein the latching portion is composed of a latching pawl formed on one of the base and the case body; and a latching hole formed on the other, for detachably engaging with the latching pawl.

6. The transfer tool according to claim 4, wherein the latching portion is composed of a latching pawl formed on one of the base and the second case; and a latching hole formed on the other, for detachably engaging with the latching pawl.

7. The transfer tool according to claim 1, wherein a pivoting direction between the base and the second case by the pivoting support portion is different from an engaging/disengaging direction between the first case and the second case.

8. The transfer tool according to claim 7, wherein the pivoting direction between the base and the second case by the pivoting support portion is substantially perpendicular to the engaging/disengaging direction between the first case and the second case.

9. The transfer tool according to claim 1, wherein the pivoting support portion is composed of a pivoting spindle formed on one of the base and the second case; and a pivoting concave portion in which the pivoting spindle pivotably passes through.

10. The transfer tool according to claim 9, wherein the pivoting spindle and the pivoting concave portion are engageable with and disengageable from each other in the releasing retention position and restricted to be engaged with and disengaged from each other by the holding portion in the use position.

11. The transfer tool according to claim 1, further comprising a transferred object receiver disposed on the side opposite to the case body of the base, for receiving the transferred object facing to the transfer surface of the transfer head in the use position, wherein a passing through space capable of passing the transferred object is formed between the transferred object receiver and the base; and the transfer surface of the transfer head is located in the passing through space.

12. The transfer tool according to claim 11, wherein the transferred object receiver is integrally pivotable with the base to the case body by the pivoting support portion.

13. The transfer tool according to claim 11, further comprising a guide portion disposed on the transferred object receiver, for guiding the transferred object to the transfer surface of the transfer head.

14. The transfer tool according to claim 13, wherein the guide portion is an auxiliary roller which is rotatable while being in contact with the transferred object from the side opposite to the transfer head.

15. The transfer tool according to claim 13, wherein the guide portion is detachable to the transferred object receiver in the releasing retention position.

16. The transfer tool according to claim 13, further comprising a transfer roller for putting the transfer material into contact with the transferred object and feeding while rotating, the transfer roller being disposed in the transfer head which is provided in the case body, wherein the transfer head including the transfer roller is held by the first case as a part of the replacement parts.

17. The transfer tool according to claim 16, wherein the transfer material is a coating film such as tape glue or a correction tape to be adhered to the transferred object, the coating film being adhered to one surface of a long tape body and forming a strip having a predetermined width within a width dimension of the transfer surface of the transfer head, and further comprising: a winding off spool for feeding the tape body attaching the transfer material with being wound and held; and a rolling up spool for recovering the tape body after adhering the transfer material to the transferred object with being wound and held, the both spools being held to the first case as a part of the replacement parts.

18. The transfer tool according to claim 17, wherein the unchangeable parts to be held by the second case in the feeding mechanism parts are rotation drive parts for rotatably driving in conjunction with the winding off spool and the rolling up spool.

19. The transfer tool according to claim 18, wherein the rotation drive parts comprise at least a winding off gear and a rolling up gear being respectively detachably engaged with the winding off spool and the rolling up spool, the winding off gear and the rolling up gear being engaged directly or indirectly.

20. The transfer tool according to claim 1, wherein the holding portion is a handheld region to be held by an operator by a hand in use.

* * * * *